US011735102B2

(12) United States Patent
Liu

(10) Patent No.: US 11,735,102 B2
(45) Date of Patent: Aug. 22, 2023

(54) DRIVING CIRCUIT AND DISPLAY DEVICE

(71) Applicant: TCL China Star Optoelectronics Technology Co., Ltd., Guangdong (CN)

(72) Inventor: Jinfeng Liu, Guangdong (CN)

(73) Assignee: TCL China Star Optoelectronics Technology Co., Ltd., Shenzhen (CN)

( * ) Notice: Subject to any disclaimer, the term of this patent is extended or adjusted under 35 U.S.C. 154(b) by 227 days.

(21) Appl. No.: 17/424,182

(22) PCT Filed: May 31, 2021

(86) PCT No.: PCT/CN2021/097383
§ 371 (c)(1),
(2) Date: Jul. 20, 2021

(87) PCT Pub. No.: WO2022/183609
PCT Pub. Date: Sep. 9, 2022

(65) Prior Publication Data

US 2023/0162663 A1 May 25, 2023

(30) Foreign Application Priority Data

Mar. 2, 2021 (CN) ..... 202110231475.1

(51) Int. Cl.
*G09G 3/32* (2016.01)

(52) U.S. Cl.
CPC ..... *G09G 3/32* (2013.01); *G09G 2310/0278* (2013.01); *G09G 2330/045* (2013.01)

(58) Field of Classification Search
CPC ..... G09G 2310/0278; G09G 2330/045; G09G 3/32
See application file for complete search history.

(56) References Cited

U.S. PATENT DOCUMENTS

2005/0017928 A1* 1/2005 Osame ..... G09G 3/3266 345/98
2006/0001635 A1 1/2006 Nakajima
2017/0270864 A1* 9/2017 So ..... G09G 3/3233
(Continued)

FOREIGN PATENT DOCUMENTS

CN 1761987 4/2006
CN 101320171 12/2008
CN 103620760 3/2014
(Continued)

*Primary Examiner* — Muhammad N Edun

(57) ABSTRACT

A driving circuit and a display device are provided. The driving circuit includes a level conversion chip, a scan line, a data line, a power line, a first transistor, a second transistor, and a light emitting unit. A protection unit is disposed between the level conversion chip and an intersection of the scan line and the power line, and the protection unit is configured to reduce current between the level conversion chip and the power line when the scan line and the power line are short-circuited. In the embodiment of the present disclosure, when the scan line and the power line are short-circuited, the protection unit reduces the current between the power line and the level conversion chip to prevent excessive current between the level conversion chip and the power line, and prevent the level conversion chip from heating and burning.

20 Claims, 5 Drawing Sheets

(56) References Cited

U.S. PATENT DOCUMENTS

2018/0350298 A1* 12/2018 Lin ..... G09G 3/3208

FOREIGN PATENT DOCUMENTS

| | | |
|---|---|---|
| CN | 103761953 | 4/2014 |
| CN | 106297702 | 1/2017 |
| CN | 107705763 | 2/2018 |
| CN | 108735145 | 11/2018 |
| CN | 108922471 | 11/2018 |
| CN | 208488960 | 2/2019 |
| CN | 111341243 | 6/2020 |
| CN | 111999936 | 11/2020 |
| KR | 10-2018-0136286 | 12/2018 |
| WO | WO 01/06484 | 1/2001 |

* cited by examiner

DRIVING CIRCUIT AND DISPLAY DEVICE

RELATED APPLICATIONS

This application is a National Phase of PCT Patent Application No. PCT/CN2021/097383 having International filing date of May 31, 2021, which claims the benefit of priority of Chinese Patent Application No. 202110231475.1 filed on Mar. 2, 2021. The contents of the above applications are all incorporated by reference as if fully set forth herein in their entirety.

FIELD AND BACKGROUND OF THE INVENTION

The present disclosure relates to a field of display device technology, and more particularly to a driving circuit and a display device.

In a conventional display panel, in order to improve display effect, micro light-emitting diodes are used as light source, and the light source is driven by a driving circuit. During use of the display panel, since a film layer such as a glass substrate is thin and material of the film layer is relatively brittle, metal traces may be short-circuited due to a collision of the display panel, and a short-circuit problem can cause local heating or even burning of the display panel, causing safety problems.

For example, a scanning signal is boosted by a level conversion chip and then input to the display panel, and at an intersection of a scan line and a power signal line, there may be a short circuit between the scan line and the power line. Therefore, an over current protection (OCP) function is set in the level conversion chip of the conventional display panel. However, a larger current is required when the display panel is turned on. In order to turn on the display panel normally, the OCP function will be turned off for a period of time. During this period of time, a short-circuit equivalent resistance of the scan line and the power signal line is very small. The small short-circuit equivalent resistance will cause a large current on the scan line, and the current on the scan line will continue to be input before the OCP function is turned on, causing the level conversion chip to heat up or even burn.

Therefore, the conventional display panel has a technical problem that when the OCP function is turned off, the short circuit of signal lines causes the level conversion chip to heat up or even burn.

SUMMARY OF THE INVENTION

Embodiments of the present disclosure provide a driving circuit and a display device, which can mitigate a technical problem that a short circuit of signal lines causes the level conversion chip to heat up or even burn.

In order to solve the above technical problem, the embodiments of the present disclosure provide the following technical solutions:

The embodiments of the present disclosure provide a driving circuit, the driving circuit includes:

A level conversion chip;

A scan line configured to output scan voltage under control of the level conversion chip, the scan line is connected with the level conversion chip;

A data line configured to output data voltage;

A power line configured to output power supply voltage;

A first transistor, a gate of the first transistor is connected with the scan line, and a first electrode of the first transistor is connected with the data line;

A second transistor, a gate of the second transistor is connected with a second electrode of the first transistor, and a first electrode of the second transistor is connected with a ground terminal;

A light emitting unit, a positive electrode of the light emitting unit is connected with the power line, and a negative electrode of the light emitting unit is connected with a second electrode of the second transistor; and A protection unit configured to reduce current between the level conversion chip and the power line when the scan line and the power line are short-circuited, and the protection unit is disposed between the level conversion chip and an intersection of the scan line and the power line.

In some embodiments, the level conversion chip includes:

A control module;

A first voltage terminal configured to output a first voltage;

A second voltage terminal configured to output a second voltage smaller than the first voltage; and A protection unit is disposed between the intersection of the scan line and the power line and at least one of the first voltage terminal or the second voltage terminal.

In some embodiments, the level conversion chip includes a third transistor, a gate of the third transistor is connected with the control module, a first electrode of the third transistor is connected with the first voltage terminal, a second electrode of the third transistor is connected with the scan line, and a protection unit is disposed between the intersection and the second electrode of the third transistor.

In some embodiments, the protection unit includes at least one of a constant resistance element, a variable resistance element, or a capacitor.

In some embodiments, the protection unit includes a constant resistance element, a value of the constant resistance element ranges from 50 ohms to 150 ohms.

In some embodiments, the level conversion chip includes a third transistor, a gate of the third transistor is connected with the control module, a first electrode of the third transistor is connected with the first voltage terminal, a second electrode of the third transistor is connected with the scan line, and a protection unit is disposed between the first electrode of the third transistor and the first voltage terminal.

In some embodiments, the level conversion chip includes a fourth transistor, a gate of the fourth transistor is connected with the control module, a first electrode of the fourth transistor is connected with the second voltage terminal, a second electrode of the fourth transistor is connected with the scan line, and a protection unit is disposed between the first electrode of the fourth transistor and the second voltage terminal.

In some embodiments, the driving circuit includes an auxiliary unit, the auxiliary unit is connected in parallel with the protection unit, the auxiliary unit is turned off when the protection unit is in an operative state, and the auxiliary unit conducts signal lines on both sides of the protection unit when the protection unit is in an inoperative state.

In some embodiments, the auxiliary unit includes a fifth transistor, a gate of the fifth transistor is connected with the scan line, a first electrode of the fifth transistor is connected with the level conversion chip, and a second electrode of the fifth transistor is connected with the scan line.

In some embodiments, the protection unit is disposed on the connection lines of the level conversion chip.

Meanwhile, the embodiments of the present disclosure provide a display device, the display device includes the driving circuit. The driving circuit includes:

A level conversion chip;

A scan line configured to output scan voltage under control of the level conversion chip, the scan line is connected with the level conversion chip;

A data line configured to output data voltage;

A power line configured to output power supply voltage;

A first transistor, a gate of the first transistor is connected with the scan line, and a first electrode of the first transistor is connected with the data line;

A second transistor, a gate of the second transistor is connected with a second electrode of the first transistor, and a first electrode of the second transistor is connected with a ground terminal;

A light emitting unit, a positive electrode of the light emitting unit is connected with the power line, and a negative electrode of the light emitting unit is connected with a second electrode of the second transistor; and A protection unit configured to reduce current between the level conversion chip and the power line when the scan line and the power line are short-circuited, and the protection unit is disposed between the level conversion chip and an intersection of the scan line and the power line.

In some embodiments, the level conversion chip includes:

A control module;

A first voltage terminal configured to output a first voltage;

A second voltage terminal configured to output a second voltage smaller than the first voltage; and A protection unit is disposed between the intersection of the scan line and the power line and at least one of the first voltage terminal or the second voltage terminal.

In some embodiments, the level conversion chip includes a third transistor, a gate of the third transistor is connected with the control module, a first electrode of the third transistor is connected with the first voltage terminal, a second electrode of the third transistor is connected with the scan line, and a protection unit is disposed between the intersection and the second electrode of the third transistor.

In some embodiments, the protection unit includes at least one of a constant resistance element, a variable resistance element, or a capacitor.

In some embodiments, the protection unit includes a constant resistance element, a value of the constant resistance element ranges from 50 ohms to 150 ohms.

In some embodiments, the level conversion chip includes a third transistor, a gate of the third transistor is connected with the control module, a first electrode of the third transistor is connected with the first voltage terminal, a second electrode of the third transistor is connected with the scan line, and a protection unit is disposed between the first electrode of the third transistor and the first voltage terminal.

In some embodiments, the level conversion chip includes a fourth transistor, a gate of the fourth transistor is connected with the control module, a first electrode of the fourth transistor is connected with the second voltage terminal, a second electrode of the fourth transistor is connected with the scan line, and a protection unit is disposed between the first electrode of the fourth transistor and the second voltage terminal.

In some embodiments, the driving circuit includes an auxiliary unit, the auxiliary unit is connected in parallel with the protection unit, the auxiliary unit is turned off when the protection unit is in an operative state, and the auxiliary unit conducts signal lines on both sides of the protection unit when the protection unit is in an inoperative state.

In some embodiments, the auxiliary unit includes a fifth transistor, a gate of the fifth transistor is connected with the scan line, a first electrode of the fifth transistor is connected with the level conversion chip, and a second electrode of the fifth transistor is connected with the scan line.

In some embodiments, wherein the protection unit is disposed on the connection lines of the level conversion chip.

The embodiments of the present disclosure provide a driving circuit and a display device. The driving circuit includes a level conversion chip, a scan line, a data line, a power line, a first transistor, a second transistor, and a light emitting unit. The scan line is connected with the level conversion chip, and the scan line is configured to output scan voltage under control of the level conversion chip. The data line is configured to output data voltage. The power line is configured to output power supply voltage. A gate of the first transistor is connected with the scan line, and a first electrode of the first transistor is connected with the data line. A gate of the second transistor is connected with a second electrode of the first transistor, and a first electrode of the second transistor is connected with a ground terminal. A positive electrode of the light emitting unit is connected with the power line, and a negative electrode of the light emitting unit is connected with a second electrode of the second transistor. A protection unit is disposed between the level conversion chip and an intersection of the scan line and the power line, and the protection unit is configured to reduce current between the level conversion chip and the power line when the scan line and the power line are short-circuited. In the embodiment of the present disclosure, a protection unit is disposed between the level conversion chip and the intersection of the scan line and the power line. When the scan line and the power line are short-circuited, the protection unit reduces the current between the power line and the level conversion chip to prevent excessive current between the level conversion chip and the power line, and prevent the level conversion chip from heating and burning.

BRIEF DESCRIPTION OF THE SEVERAL VIEWS OF THE DRAWINGS

The embodiments of the present disclosure will be described hereinafter with reference to the accompanying drawings, the technical solutions and the beneficial effects of the present disclosure will be obviously.

DESCRIPTION OF SPECIFIC EMBODIMENTS OF THE INVENTION

The following embodiments refer to the accompanying drawings for exemplifying specific implementable embodiments of the present disclosure in a suitable computing environment. It should be noted that the exemplary described embodiments are configured to describe and understand the present disclosure, but the present disclosure is not limited thereto.

Figure 1:
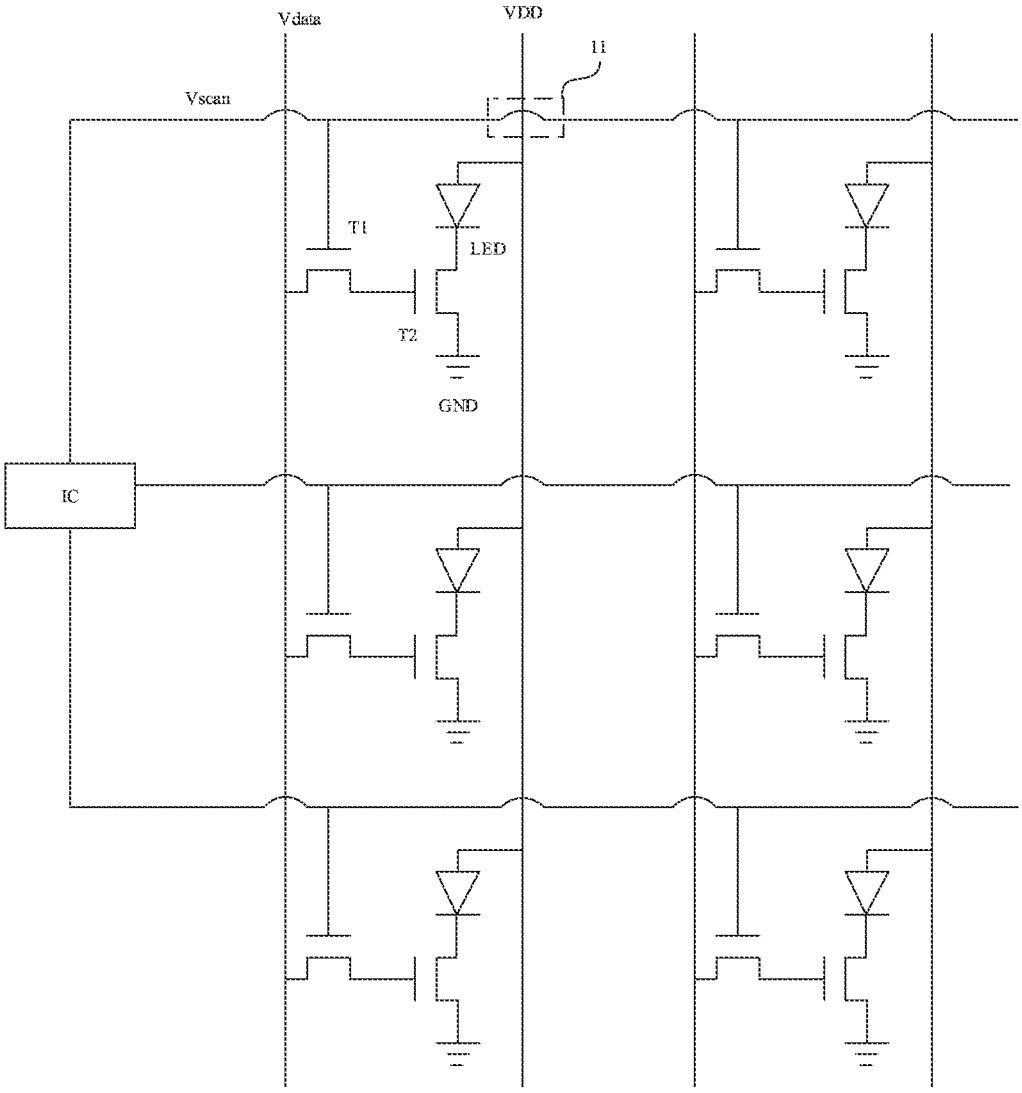
FIG. 1 is a schematic diagram of a conventional display panel.

Refer to FIG. 1, in a conventional display panel, a level conversion chip IC is connected with a scan line Vscan, and the scan line Vscan is connected with a gate of a switching transistor T1. One electrode of the switching transistor T1 is connected with data lines, and the other electrode of the switching transistor T1 is connected with a gate of a driving transistor T2. One electrode of the driving transistor T2 is connected with a negative electrode of a light emitting unit, and the other electrode of the driving transistor T2 is connected with a ground terminal GND. A positive electrode of the light emitting unit is connected with a power line VDD.

During the normal driving process of the display panel, the level conversion chip IC controls the scan signal outputted by the scan line Vscan, so that the scan line Vscan outputs different potentials to turn on or off the switching transistors T1. When the current in the level conversion chip IC becomes excessive, an OCP function is turned on to prevent the level conversion chip from being burned by an excessive current. Since the turning-on of the display panel requires a larger current, the OCP function is turned off during an turning-on stage of the display panel. At this stage, in an intersection 11 of the power line VDD and the scan line Vscan, when a collision of the display panel causes the power line VDD to be electrically or physically connected to the scan line Vscan, the OCP function is turned off and fails to function, resulting in the heating or even burning of the level conversion chip. Further details are as follows.

Figure 2:
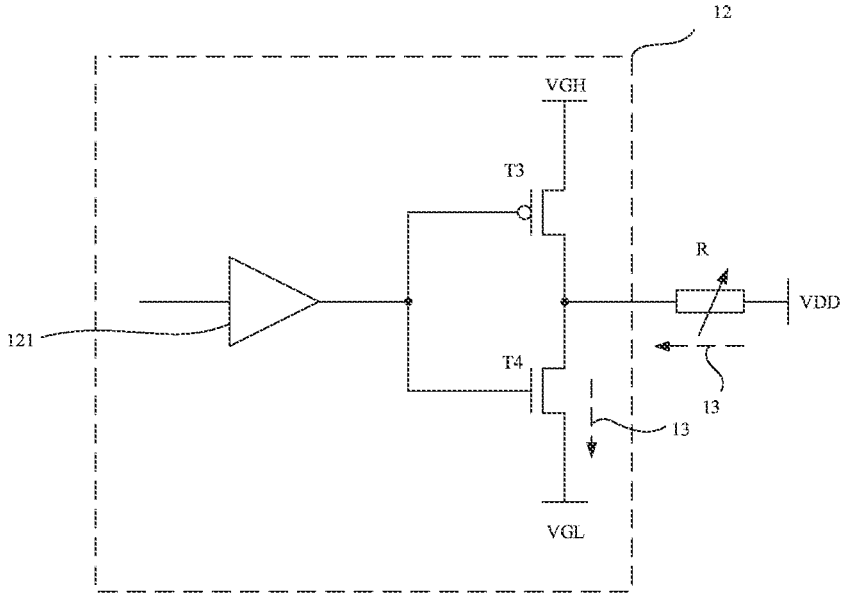
FIG. 2 is a schematic diagram of the conventional display panel when a scan line and a power line are short-circuited.

Refer to FIG. 2, the level conversion chip 12 includes a control module 121, a transistor T3, a transistor T4, a high potential voltage terminal VGH, and a low potential voltage terminal VGL. When the transistor T4 is turned on, an equivalent resistance R is formed at the short circuit between the power supply line VDD and the scan line Vscan. Since the output voltage of the power line VDD is greater than that of the low potential voltage terminal VGL, the current 13 flows from the power line VDD to the low potential voltage terminal VGL. Since a value of the equivalent resistance R is small and the current 13 is large, the transistor T4 may be burned.

Turn-on conditions of the transistor T3 and the transistor T4 are opposite. For example, the transistor T3 is turned on when a gate of the transistor T3 receives a low potential, and the transistor T4 is turned on when a gate of the transistor T4 receives a high potential, so that different voltages are input to the scan line at different stages.

Therefore, the conventional display panel has a technical problem that when the OCP function is turned off, the short circuit of signal lines causes the level conversion chip to heat up or even burn.

The embodiments of the present disclosure provide a driving circuit and a display device to mitigate above technical problems.

Figure 3:
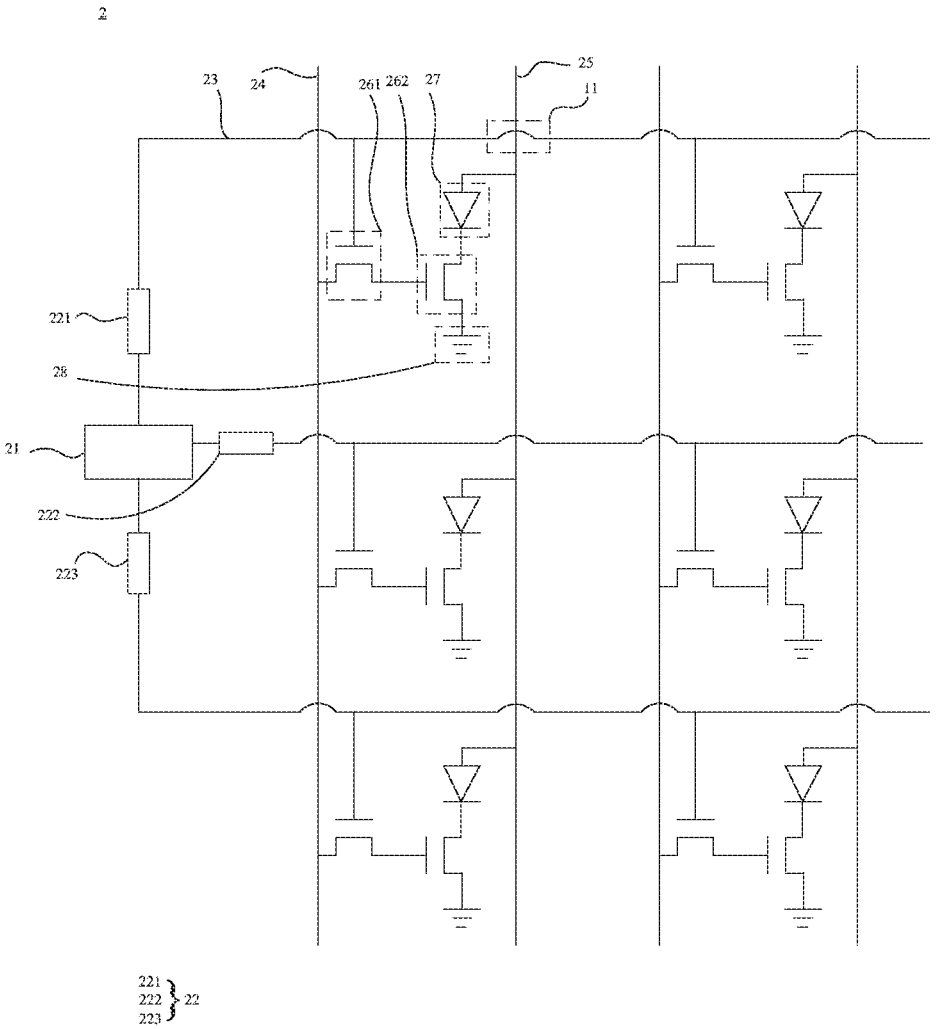
FIG. 3 is a schematic diagram of a display panel provided by an embodiment of the present disclosure.

Refer to FIG. 3, the embodiments of the present disclosure provide a driving circuit, the driving circuit 2 includes:

A level conversion chip 21;

A scan line 23 configured to output scan voltage under control of the level conversion chip 21, and the scan line 23 is connected with the level conversion chip 21;

A data line 24 configured to output data voltage;

A power line 25 configured to output power supply voltage;

A first transistor 261, wherein a gate of the first transistor 261 is connected with the scan line 23, and a first electrode of the first transistor 261 is connected with the data line 24;

A second transistor 262, wherein a gate of the second transistor 262 is connected with a second electrode of the first transistor 261, and a first electrode of the second transistor 262 is connected with a ground terminal 28;

A light emitting unit 27, wherein a positive electrode of the light emitting unit 27 is connected with the power line 25, and a negative electrode of the light emitting unit 27 is connected with a second electrode of the second transistor 262; and A protection unit 22 configured to reduce current between the level conversion chip 21 and the power line 25 when the scan line 23 and the power line 25 are short-circuited, and the protection unit 22 is disposed between the level conversion chip 21 and an intersection 11 of the scan line 23 and the power line 25.

In the embodiment of the present disclosure, a protection unit is disposed between the level conversion chip and the intersection of the scan line and the power line. When the scan line and the power line are short-circuited, the protection unit reduces the current between the power line and the level conversion chip to prevent excessive current between the level conversion chip and the power line, and prevent the level conversion chip from heating and burning.

When the display panel includes multiple scan lines and multiple power lines, there will be a short circuit at the intersection of any scan line and any power line. In an embodiment of the present disclosure, the protection unit is disposed between the level conversion chip and the intersection of all scan lines and power lines. The protection unit is disposed on all output terminals of the level conversion chip. When any scan line and power line are short-circuited, the protection unit can protect the level conversion chip to prevent the level conversion chip from being burned due to excessive current.

Refer to FIG. 3, the protection unit 22 includes a first protection unit 221, a second protection unit 222, and a third protection unit 223. The protection unit 22 is disposed between the intersection 11 of each scan line 23 and power line 25 and the level conversion chip 21. When any scan line and power line are short-circuited, the protection unit reduces the current between the power line and the level conversion chip to prevent the level conversion chip from burning.

In the embodiments described above, FIG. 3 shows three scan lines and three corresponding protection units. However, in a practical disclosure of the driving circuit, the number of protection units is set according to the actual number of scan lines.

In the embodiments described above, the protection unit is disposed between the level conversion chip and the intersection of the scan line and the power line closest to the level conversion chip. In the embodiment of the present disclosure, the protection unit can also be disposed between a first intersection of the scan line and the power line and a second intersection of the scan line and the power line. The embodiment of the present disclosure is not limited to this, and the position of the protection units can be set according to requirements.

When the scan line and the power line are short-circuited, a large current is generated between the first voltage terminal and the second voltage terminal in the level conversion chip and the power line. In order to solve this problem, in one embodiment, the level conversion chip includes:

A control module;

A first voltage terminal configured to output a first voltage;

A second voltage terminal configured to output a second voltage smaller than the first voltage; and A protection unit is disposed between the intersection of the scan line and the power line and at least one of the first voltage terminal or the second voltage terminal. When the scan line and the power line are short-circuited, the protection unit reduces current between the first voltage terminal and the power line, and current between the second voltage terminal and the power line, such that components located between the power line and the first voltage terminal, and components located between the power line and the second voltage terminal can be not burned, and the level conversion chip will not be burned.

Figure 4:
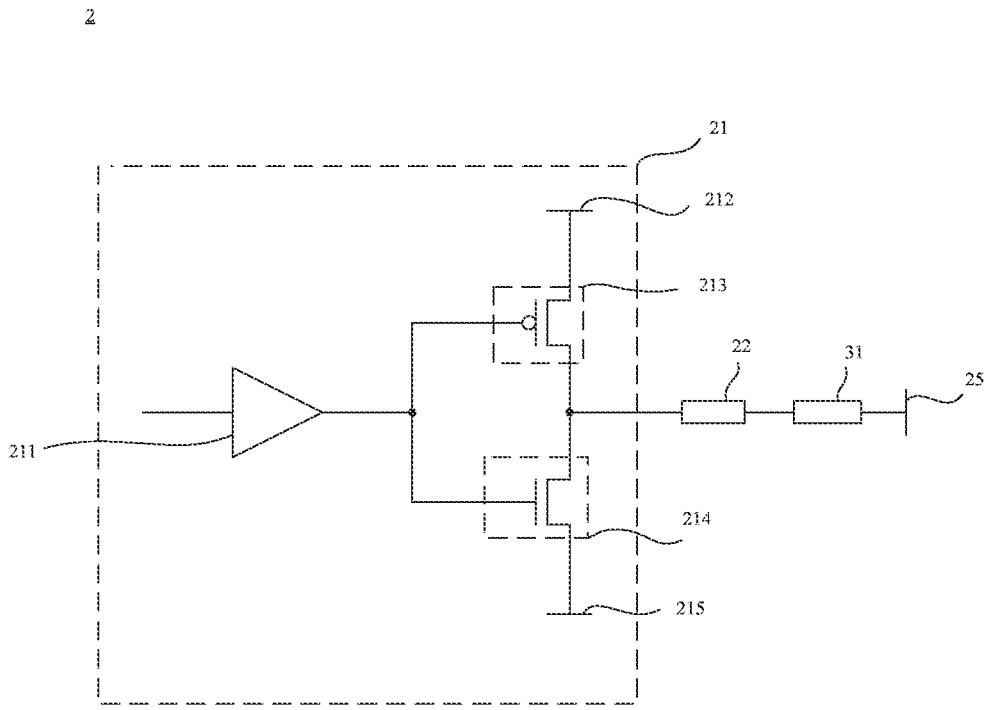
FIG. 4 is a schematic diagram of the display panel provided by an embodiment of the present disclosure when a scan line and a power line are short-circuited.

Refer to FIG. 3 and FIG. 4, when the scan line 23 and the power line 25 are short-circuited, value of the equivalent resistance 31 at the short-circuit between the power line 25 and the scan line 23 is small. The level conversion chip 21 includes a control module 211, a first voltage terminal 212, and a second voltage terminal 215. The control module 211 is configured to control magnitude of voltage output to the scan line (not shown in FIG. 4). The protection unit 22 is disposed between the first voltage terminal 212 and the second voltage terminal 215. The protection unit 22 reduces current between the first voltage terminal and the power line, and current between the second voltage terminal and the power line, such that components (e.g., transistor) located between the power line and the first voltage terminal, and components located between the power line and the second voltage terminal can be not burned, and the level conversion chip will not be burned.

A third transistor is disposed between the first voltage terminal and the scan line, when the scan line and the power line are short-circuited, current between the power line and the first voltage terminal is large, causing the third transistor to be burned. In order to solve this problem, in one embodiment, refer to FIG. 4, the level conversion chip 21 includes a third transistor 213, a gate of the third transistor 213 is connected with the control module 211, a first electrode of the third transistor 213 is connected with the first voltage terminal 212, a second electrode of the third transistor 213 is connected with the scan line, and a protection unit 22 is disposed between the intersection and the second electrode of the third transistor 213. By providing the protection unit between the intersection and the second electrode of the third transistor, when the scan line and the power line are short-circuited, the protection unit prevents the third transistor and the display panel from being burned due to the excessive current passing through the third transistor.

The equivalent resistance 31 is shown in FIG. 4, the intersection of the scan line and the power line is equivalent to the position of the equivalent resistor 31.

In one embodiment, the protection unit includes at least one of a constant resistance element, a variable resistance element, or a capacitor. When the scan line and the power line are short-circuited, the protection unit reduces current between the power line and the level conversion chip. At least one of a constant resistance element, a variable resistance element, or a capacitor is connected in series between the power line and the level conversion chip. At least one of a constant resistance element, a variable resistance element, or a capacitor divides the voltage between the power line and the level conversion chip to reduce the current between the power line and the level conversion chip, thereby, the level conversion chip can be protected.

In one embodiment, the protection unit includes a constant resistance element, and a value of the constant resistance element ranges from 50 ohms to 150 ohms. When the value of the constant resistance element is too small, the reduction of the current will be small, and the level conversion chip may still be burned. When the value of the constant resistance element is too large, it causes the signal rise and fall process to take a long time. Therefore, the range of the constant resistance element is set to 50 ohms to 150 ohms.

A third transistor is disposed between the first voltage terminal and the scan line, and when the scan line and the power line are short-circuited, current between the power line and the first voltage terminal is large, causing the third transistor to be burned. In order to solve this problem, in one embodiment, refer to FIG. 5, the level conversion chip 21 includes a third transistor 213, a gate of the third transistor 213 is connected with the control module 211, a first electrode of the third transistor 213 is connected with the first voltage terminal 212, a second electrode of the third transistor 213 is connected with the scan line, and a protection unit 22 is disposed between the first electrode of the third transistor 213 and the first voltage terminal 212. By providing the protection unit between the first voltage terminal and the third transistor, when the scan line and the power line are short-circuited to form a short-circuit equivalent resistance, the protection unit reduces the current between the power line and the first voltage terminal, and prevents the third transistor from being burned due to excessive current passing through the third transistor.

A fourth transistor is disposed between the second voltage terminal and the scan line, when the scan line and the power line are short-circuited, current between the power line and the second voltage terminal is large, causing the fourth transistor to be burned. In order to solve this problem, in one embodiment, refer to FIG. 6, the level conversion chip 21 includes a fourth transistor 214, a gate of the fourth transistor 214 is connected with the control module 211, a first electrode of the fourth transistor 214 is connected with the second voltage terminal, a second electrode of the fourth transistor 214 is connected with the scan line, and a protection unit 22 is disposed between the first electrode of the fourth transistor 214 and the second voltage terminal 215. By providing the protection unit between the fourth transistor and the second voltage terminal, when the scan line and the power line are short-circuited to form a short-circuit equivalent resistance, the protection unit reduces the current between the power line and the second voltage terminal, and prevents the fourth transistor from being burned due to excessive current passing through the fourth transistor, and protects the level conversion chip and the display panel.

Figure 5:
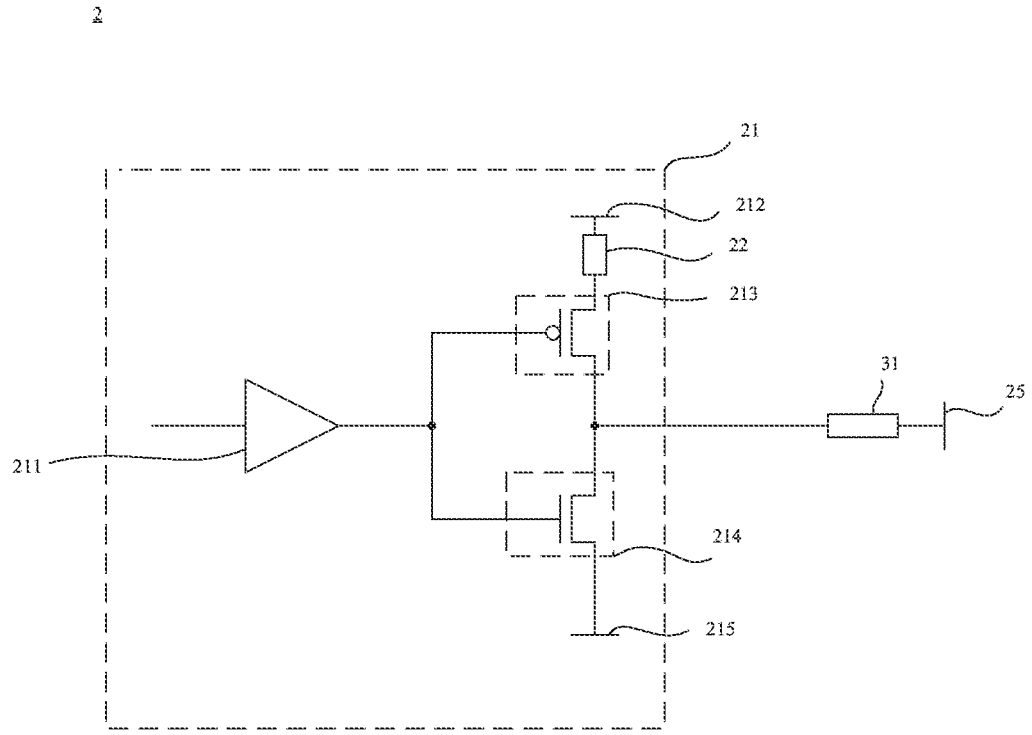
FIG. 5 is another schematic diagram of the display panel provided by an embodiment of the present disclosure when the scan line and the power line are short-circuited.
Figure 6:
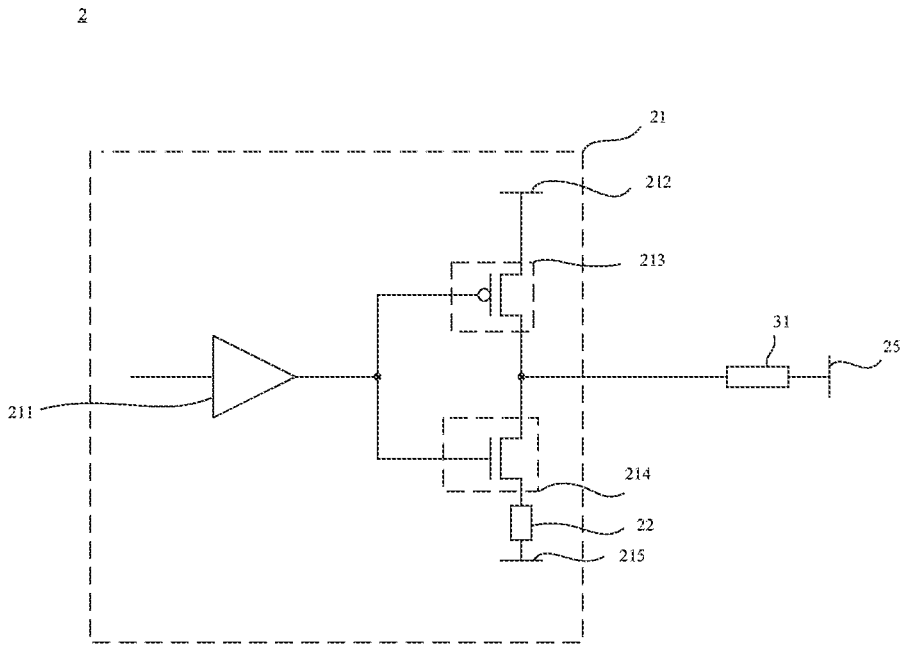
FIG. 6 is yet another schematic diagram of the display panel provided by an embodiment of the present disclosure when the scan line and the power line are short-circuited.

Refer to FIGS. 4-6, turn-on conditions of the third transistor 213 and the fourth transistor 214 are opposite. For example, the third transistor 213 is turned on when a gate of the third transistor 213 receives a low potential, and the fourth transistor 214 is turned on when a gate of the third transistor 213 receives a high potential, and when a transistor is turned on at any time, the voltage output by the level conversion chip to the scan line is a first voltage or a second voltage.

In the embodiments described above, the protection unit is disposed on the scan line and the trace in the level conversion chip. A resistance of the transistor between the scan line and the level conversion chip is small, and there are no other components that can cause voltage division between the level conversion chip and the scan line. Therefore, the voltage output by the level conversion chip to the scan line is not affected or is less affected (the resistance of the transistor causes a certain voltage division).

In one embodiment, the protection unit is disposed on the power line. That is to say, when the voltage division of the protection unit to the light emitting unit is not considered, the protection unit can also be set on the power line. When the scan line and the power line are short-circuited, the protection unit reduces the current between the power line and the level conversion chip, and prevents level conversion chip from being burned.

The protection unit has a certain impact on the voltage output to the scan line. In order to solve this problem, in one embodiment, the driving circuit includes an auxiliary unit, the auxiliary unit is connected in parallel with the protection unit, the auxiliary unit is turned off when the protection unit is in an operative state, and the auxiliary unit conducts signal lines on both sides of the protection unit when the protection unit is in an inoperative state. When the scan line and the power line are short-circuited, the auxiliary unit is turned off, and the protection unit reduces the current between the power line and the level conversion chip. When the scan line and the power line are not short-circuited, the auxiliary unit conducts signal lines on both sides of the protection unit, prevents the voltage division caused by the protection unit to reduce the voltage output to the scan line, and improves the speed of voltage rise and fall.

The signal lines include the scan line and the trace in the level conversion chip. The type of signal line depends on the setting position of the protection unit. For example, when the protection unit is disposed on the scan line, the signal line is the scan line.

Figure 7:
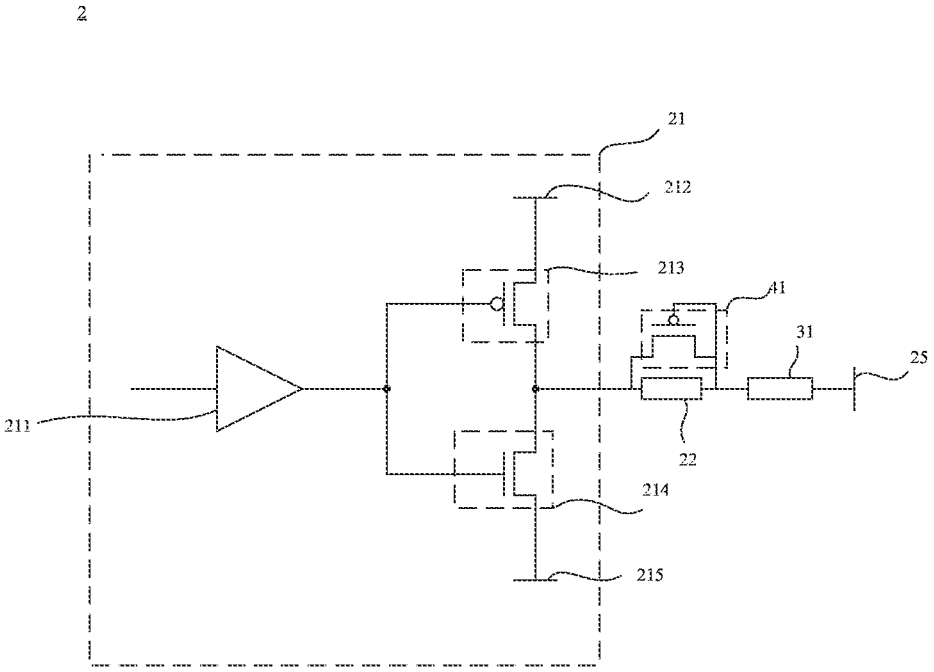
FIG. 7 is still another diagram of the display panel provided by an embodiment of the present disclosure when the scan line and the power line are short-circuited.

In one embodiment, refer to FIG. 7, the auxiliary unit includes a fifth transistor 41, a gate of the fifth transistor 41 is connected with the scan line, a first electrode of the fifth transistor 41 is connected with the level conversion chip 21, and a second electrode of the fifth transistor 41 is connected with the scan line. By connecting the protection unit with the fifth transistor, the protection unit reduces the current between the power line and the level conversion chip when the scan line and the power line are short-circuited. When the scan line and the power line are not short-circuited, the fifth transistor is turned on, and the fifth transistor directly connects the signal lines or signal terminals located at both ends of the protection unit to prevent the voltage division caused by the protection unit from reducing the output voltage.

In FIG. 7, working process of the fifth transistor 41 and the protection unit 22 is as follows: a gate of the fifth transistor 41 is connected with the scan line, and a second electrode of the fifth transistor 41 is connected with the scan line. When the scan line and the power line are short-circuited, the gate voltage is large, and the fifth transistor is turned off, and the protection unit 22 reduces the current between the power line 25 and the level conversion chip 21 (the direction of the voltage is from the power line to the level conversion chip). When the scan line and the power line are not short-circuited, the gate voltage is small, and the fifth transistor is turned on to prevent the protection unit from lowering the voltage (the direction of the voltage is from the level conversion chip to the scan line).

In the following embodiments, specific examples are given to illustrate working process of the protection unit.

Take for example that the voltage of the power line is 30 V (volt), the voltage of the second voltage terminal is −3 V, and the resistance of the third transistor ranges from 5 ohms to 15 ohms. When the scan line and the power line are short-circuited (the scan line and the power line are physically or electrically connected), the equivalent resistance is 0 or close to 0, and the current between the power line and the second voltage terminal is 2.2 A (ampere) to 6.6 A. An excessive current causes the fourth transistor to heat up or even burn. Take the setting of a protection unit with a resistance of 100 ohms as an example, the current between the power line and the second voltage terminal is reduced to 0.28 A to 0.31 A. The protection unit effectively reduces the current between the power line and the second voltage terminal, and prevents the fourth transistor from burning out and causing the display panel to burn out.

Take for example that the voltage of the power line is 30 V (volt), the voltage of the first voltage terminal is 20 V, and the resistance of the fourth transistor ranges from 5 ohms to 15 ohms. When the scan line and the power line are short-circuited (the scan line and the power line are physically or electrically connected), the equivalent resistance is 0 or close to 0, and the current between the power line and the first voltage terminal is 0.67 A to 2 A. An excessive current causes the third transistor to heat up or even burn. Take the setting of a protection unit with a resistance of 100 ohms as an example, the current between the power line and the first voltage terminal is reduced to 0.08 A to 0.09 A. The protection unit effectively reduces the current between the power line and the first voltage terminal, and prevents the third transistor from burning out and causing the display panel to burn out.

In the embodiments described above, take the small voltage at the first voltage terminal as an example. When the voltage at the first voltage terminal is larger than the power supply voltage, for example, 35 V, voltage backflow does not occur, and there is no need to provide a protection unit for the third transistor.

In the embodiments described above, working process of the protection unit when the OCP function is turned off is described. If the OCP function is turned on, when the scan line and the power line are short-circuited, the OCP function can turn off the third transistor and the fourth transistor to prevent the transistor from being burned.

In the embodiments described above, the protection unit disposed between the level conversion chip and the intersection of the scan line and the power line is described in detail.

In the driving circuit, the scan line and data line may be short-circuited. When the voltage of the data line is large, the current between the data line and the level conversion chip is large and burns the level conversion chip. In one embodiment, the protection unit is disposed between the level conversion chip and an intersection of the scan line and the data line. When the voltage of the data line is large, the protection unit reduces current between the level conversion chip and the data line when the scan line and the data line are short-circuited, and prevents excessive current from burning the level conversion chip and causing the display panel to burn.

In the embodiments described above, the way to set the level conversion chip when the voltage of the data line is large is described in detail. In the other embodiments of the present disclosure, when the voltage of the data line is small, the current between the data line and the level conversion chip is not enough to burn the level conversion chip when the scan line and the data line are short-circuited, and there is no need to provide a protection unit between the level conversion chip and an intersection of the scan line and the data line.

In one embodiment, the protection unit is disposed on the connection line of the level conversion chip. A metal trace with a larger resistance is disposed on the connection line of the output terminal of the level conversion chip, and the metal trace forms a protection unit. When the scan line and the power line are short-circuited, the protection unit reduces current between the level conversion chip and the power line.

In one embodiment, the protection unit is disposed on the scan line. A metal trace with a larger resistance is disposed on the scan line, and the metal trace forms a protection unit. When the scan line and the power line are short-circuited, the protection unit reduces current between the level conversion chip and the power line.

In one embodiment, the protection unit can be formed by forming metal trace on a gate layer, and resistance of the metal trace is larger than resistance of the gate layer. The metal trace is connected between the level conversion chip and the intersection of the scan line and the power line.

In one embodiment, the protection unit can be formed on a drain layer, and the protection unit is connected with the intersection of the scan line and the power line by a via.

An embodiment of the present disclosure also provides a display device, the display device includes any one of the driving circuit in the above embodiments.

In one embodiment, the display device includes a liquid crystal display panel and a backlight module, and the liquid crystal display panel includes a data line, a scan line, a power line, a first transistor, a second transistor, and a level conversion chip. The backlight module includes a light emitting unit. In the other embodiments of the present disclosure, the display device includes a miniature liquid crystal display panel, the light emitting unit is disposed in the miniature liquid crystal display panel, and the miniature liquid crystal display panel includes the data line, the scan line, the power line, the first transistor, the second transistor, and the level conversion chip. The display device may also include an organic light emitting diode (OLED) display panel.

In one embodiment, in the display device, the level conversion chip includes:

A control module;

A first voltage terminal configured to output a first voltage;

A second voltage terminal configured to output a second voltage smaller than the first voltage; and A protection unit is disposed between the intersection of the scan line and the power line and at least one of the first voltage terminal or the second voltage terminal.

In one embodiment, in the display device, the level conversion chip includes a third transistor, a gate of the third transistor is connected with the control module, a first electrode of the third transistor is connected with the first voltage terminal, a second electrode of the third transistor is connected with the scan line, and a protection unit is disposed between the intersection and the second electrode of the third transistor.

In one embodiment, in the display device, the protection unit includes at least one of a constant resistance element, a variable resistance element, or a capacitor.

In one embodiment, in the display device, the protection unit includes a constant resistance element, and a value of the constant resistance element ranges from 50 ohms to 150 ohms.

In one embodiment, in the display device, the level conversion chip includes a third transistor, a gate of the third transistor is connected with the control module, a first electrode of the third transistor is connected with the first voltage terminal, a second electrode of the third transistor is connected with the scan line, and a protection unit is disposed between the first electrode of the third transistor and the first voltage terminal.

In one embodiment, in the display device, the level conversion chip includes a fourth transistor, a gate of the fourth transistor is connected with the control module, a first electrode of the fourth transistor is connected with the second voltage terminal, a second electrode of the fourth transistor is connected with the scan line, and a protection unit is disposed between the first electrode of the fourth transistor and the second voltage terminal.

In one embodiment, in the display device, the driving circuit includes an auxiliary unit, the auxiliary unit is connected in parallel with the protection unit, the auxiliary unit is turned off when the protection unit is in an operative state, and the auxiliary unit conducts signal lines on both sides of the protection unit when the protection unit is in an inoperative state.

In one embodiment, in the display device, the auxiliary unit includes a fifth transistor, a gate of the fifth transistor is connected with the scan line, a first electrode of the fifth transistor is connected with the level conversion chip, and a second electrode of the fifth transistor is connected with the scan line.

In one embodiment, in the display device, the protection unit is disposed on the connection lines of the level conversion chip.

According to the embodiments described above:

The embodiments of the present disclosure provide a driving circuit and a display device. The driving circuit includes a level conversion chip, a scan line, a data line, a power line, a first transistor, a second transistor, and a light emitting unit. The scan line is connected with the level conversion chip, and the scan line is configured to output scan voltage under control of the level conversion chip. The data line is configured to output data voltage. The power line is configured to output power supply voltage. A gate of the first transistor is connected with the scan line, and a first electrode of the first transistor is connected with the data line. A gate of the second transistor is connected with a second electrode of the first transistor, and a first electrode of the second transistor is connected with a ground terminal. A positive electrode of the light emitting unit is connected with the power line, and a negative electrode of the light emitting unit is connected with a second electrode of the second transistor. A protection unit is disposed between the level conversion chip and an intersection of the scan line and the power line, and the protection unit is configured to reduce current between the level conversion chip and the power line when the scan line and the power line are short-circuited. In the embodiment of the present disclosure, a protection unit is disposed between the level conversion chip and the intersection of the scan line and the power line. When the scan line and the power line are short-circuited, the protection unit reduces the current between the power line and the level conversion chip to prevent excessive current between the level conversion chip and the power line, and prevent the level conversion chip from heating and burning.

In the above embodiments, the description of each embodiment has its own emphasis, for a part that is not detailed in an embodiment, you can refer to the related descriptions of other embodiments.

The driving circuit and display device provided by the embodiments of the present disclosure are described in detail above, specific examples are used to explain the principle and implementation of the present disclosure, the descriptions of the above embodiments are only used to help understand the present disclosure technical solutions and their core ideas. Those of ordinary skill in the art should understand that they can still modify the technical solutions described in the foregoing embodiments, or equivalently replace some of the technical features. These modifications or replacements, and the essence of the corresponding technical solutions does not deviate from the scope of the technical solutions of the embodiments of the present disclosure.

What is claimed is:

1. A driving circuit, comprising:

a level conversion chip;

a scan line configured to output scan voltage under control of the level conversion chip, wherein the scan line is connected with the level conversion chip;

a data line configured to output data voltage;

a power line configured to output power supply voltage;

a first transistor, wherein a gate of the first transistor is connected with the scan line, and a first electrode of the first transistor is connected with the data line;

a second transistor, wherein a gate of the second transistor is connected with a second electrode of the first transistor, and a first electrode of the second transistor is connected with a ground terminal;

a light emitting unit, wherein a positive electrode of the light emitting unit is connected with the power line, and a negative electrode of the light emitting unit is connected with a second electrode of the second transistor; and a protection unit configured to reduce current between the level conversion chip and the power line when the scan line and the power line are short-circuited, wherein the protection unit is disposed between the level conversion chip and an intersection of the scan line and the power line.

2. The driving circuit of claim 1, wherein the level conversion chip comprises:

a control module;

a first voltage terminal configured to output a first voltage;

a second voltage terminal configured to output a second voltage smaller than the first voltage; and the protection unit is disposed between the intersection of the scan line and the power line and at least one of the first voltage terminal or the second voltage terminal.

3. The driving circuit of claim 2, wherein the level conversion chip comprises a third transistor, a gate of the third transistor is connected with the control module, a first electrode of the third transistor is connected with the first voltage terminal, a second electrode of the third transistor is connected with the scan line, and the protection unit is disposed between the intersection of the scan line and the power line and the second electrode of the third transistor.

4. The driving circuit of claim 3, wherein the protection unit comprises at least one of a constant resistance element, a variable resistance element, or a capacitor.

5. The driving circuit of claim 4, wherein the protection unit comprises the constant resistance element, and a value of the constant resistance element ranges from 50 ohms to 150 ohms.

6. The driving circuit of claim 2, wherein the level conversion chip comprises a third transistor, a gate of the third transistor is connected with the control module, a first electrode of the third transistor is connected with the first voltage terminal, a second electrode of the third transistor is connected with the scan line, and the protection unit is disposed between the first electrode of the third transistor and the first voltage terminal.

7. The driving circuit of claim 2, wherein the level conversion chip comprises a fourth transistor, a gate of the fourth transistor is connected with the control module, a first electrode of the fourth transistor is connected with the second voltage terminal, a second electrode of the fourth transistor is connected with the scan line, and the protection unit is disposed between the first electrode of the fourth transistor and the second voltage terminal.

8. The driving circuit of claim 1, wherein the driving circuit further comprises an auxiliary unit, the auxiliary unit is connected in parallel with the protection unit, the auxiliary unit is turned off when the protection unit is in an operative state, and the auxiliary unit conducts signal lines on both sides of the protection unit when the protection unit is in an inoperative state.

9. The driving circuit of claim 8, wherein the auxiliary unit comprises a fifth transistor, a gate of the fifth transistor is connected with the scan line, a first electrode of the fifth transistor is connected with the level conversion chip, and a second electrode of the fifth transistor is connected with the scan line.

10. The driving circuit of claim 1, wherein the protection unit is disposed on connection lines of the level conversion chip.

11. A display device, comprising a driving circuit, wherein the driving circuit comprises:

a level conversion chip;

a scan line configured to output scan voltage under control of the level conversion chip, wherein the scan line is connected with the level conversion chip;

a data line configured to output data voltage;

a power line configured to output power supply voltage;

a first transistor, wherein a gate of the first transistor is connected with the scan line, and a first electrode of the first transistor is connected with the data line;

a second transistor, wherein a gate of the second transistor is connected with a second electrode of the first transistor, and a first electrode of the second transistor is connected with a ground terminal;

a light emitting unit, wherein a positive electrode of the light emitting unit is connected with the power line, and a negative electrode of the light emitting unit is connected with a second electrode of the second transistor; and a protection unit configured to reduce current between the level conversion chip and the power line when the scan line and the power line are short-circuited, wherein the protection unit is disposed between the level conversion chip and an intersection of the scan line and the power line.

12. The display device of claim 11, wherein the level conversion chip comprises:

a control module;

a first voltage terminal configured to output a first voltage;

a second voltage terminal configured to output a second voltage smaller than the first voltage; and the protection unit is disposed between the intersection of the scan line and the power line and at least one of the first voltage terminal or the second voltage terminal.

13. The display device of claim 12, wherein the level conversion chip comprises a third transistor, a gate of the third transistor is connected with the control module, a first electrode of the third transistor is connected with the first voltage terminal, a second electrode of the third transistor is connected with the scan line, and the protection unit is disposed between the intersection of the scan line and the power line and the second electrode of the third transistor.

14. The display device of claim 13, wherein the protection unit comprises at least one of a constant resistance element, a variable resistance element, or a capacitor.

15. The display device of claim 14, wherein the protection unit comprises the constant resistance element, and a value of the constant resistance element ranges from 50 ohms to 150 ohms.

16. The display device of claim 12, wherein the level conversion chip comprises a third transistor, a gate of the third transistor is connected with the control module, a first electrode of the third transistor is connected with the first voltage terminal, a second electrode of the third transistor is connected with the scan line, and the protection unit is disposed between the first electrode of the third transistor and the first voltage terminal.

17. The display device of claim 12, wherein the level conversion chip comprises a fourth transistor, a gate of the fourth transistor is connected with the control module, a first electrode of the fourth transistor is connected with the second voltage terminal, a second electrode of the fourth transistor is connected with the scan line, and the protection unit is disposed between the first electrode of the fourth transistor and the second voltage terminal.

18. The display device of claim 11, wherein the driving circuit further comprises an auxiliary unit, the auxiliary unit is connected in parallel with the protection unit, the auxiliary unit is turned off when the protection unit is in an operative state, and the auxiliary unit conducts signal lines on both sides of the protection unit when the protection unit is in an inoperative state.

19. The display device of claim 18, wherein the auxiliary unit comprises a fifth transistor, a gate of the fifth transistor is connected with the scan line, a first electrode of the fifth transistor is connected with the level conversion chip, and a second electrode of the fifth transistor is connected with the scan line.

20. The display device of claim 11, wherein the protection unit is disposed on connection lines of the level conversion chip.

* * * * *